US005425213A

United States Patent [19]

Abe

[11] Patent Number: 5,425,213

[45] Date of Patent: Jun. 20, 1995

[54] APPARATUS AND METHOD FOR UPRIGHTLY SECURING STEEL FRAME POSTS

[75] Inventor: Ayao Abe, Sendai, Japan

[73] Assignee: Kabushikigaisha Koa, Sendai, Japan

[21] Appl. No.: 77,072

[22] Filed: Jun. 16, 1993

[30] Foreign Application Priority Data

Jun. 18, 1992 [JP] Japan ..... 4-202860

[51] Int. Cl.[6] ..... E04B 1/18; E04H 12/34

[52] U.S. Cl. ..... 52/741.1; 52/126.3; 52/745.2; 52/749; 182/36

[58] Field of Search ..... 182/36, 39; 248/913; 52/126.1, 126.3, 126.5, 126.6, 126.7, 745.2, 741.1, 749; 269/904, 910; 104/98; 105/28

[56] References Cited

U.S. PATENT DOCUMENTS 1,719,967 7/1929 Crist ..... 105/28
3,124,018 3/1964 Gough ..... 248/913
3,927,732 12/1975 Ooka et al. ..... 182/36
4,233,740 11/1980 Bunn et al. ..... 248/913
4,590,719 5/1986 McKibbin ..... 52/749
5,018,923 5/1991 Melan et al. ..... 52/749

*Primary Examiner*—Carl D. Friedman
*Assistant Examiner*—Christopher Todd Kent
*Attorney, Agent, or Firm*—Ronald R. Snider

[57] ABSTRACT

Steel frame posts are uprightly secured by an apparatus having a stable, wide access platform with X-Y adjusters for adjusting the position of the steel frame posts while the posts are temporarily supported. The access platform has wheels to travel by itself along a pair of rails. The X-Y adjusters are disposed at an edge of the access platform and are composed of a longitudinal slide and a transverse slide, which are provided on a fixed base and are slid to a suitable position for permanent bolting of the steel frame posts by easy controls in use of respective feeding handles. A coupler connected to the steel frame post by a vice is coupled with a protruding bar provided at a top of the X-Y adjuster for temporarily holding the steel frame post.

14 Claims, 3 Drawing Sheets

APPARATUS AND METHOD FOR UPRIGHTLY SECURING STEEL FRAME POSTS

CROSS-REFERENCE TO RELATED APPLICATION

This application claims priority benefits under 35 U.S.C. §119 of Japanese application Serial No. 4-202,860, filed Jun. 18th, 1992, the entire disclosure of which is incorporated herein by reference.

BACKGROUND OF THE INVENTION

1. Field of the Invention

This invention relates to an apparatus and a method for uprightly securing steel frame posts by which adjustment of a position of the steel frame post is safely, fast, and readily proceeded using an access platform and special jigs.

2. Description of Related Art

In conventional work for steel frame constructions in association with a high location, the position of respective steel frame posts is uprightly adjusted, as shown in FIG. 5, by using a crane to hoist respective steel frame posts. In order to build such posts uprightly, four wire ropes are pulled toward four sides to temporarily secure the position of the post, and while the crane swings a base side of the post, turnbuckles of the wire ropes are adjusted to obtain an upright position of the post for permanently bolting work.

However, such conventional work for uprightly securing the steel frame posts is accompanied by work on a high location and requires high-level skills. That is, the construction for uprightly securing the steel frame posts under the condition that the post is hoisted by the crane and pulled toward four sides, involves extremely unstable works. The work for attaching temporary scaffolds is accompanied by considerable risks. Rebuilding one steel frame post needs at least four workers and takes time. Work on high locations on the post where the scaffolds are unstable not only requires high-level skills but also falls in inefficiency. Moreover, it is difficult to ensure a number of those skilled to work because of shortage of work force availability.

SUMMARY OF THE INVENTION

It is an object of the invention to provide an apparatus and a method for uprightly securing steel frame posts, in which the steel frame posts are temporarily secured with safety and ease, in which stable access platform gives workers stable feeling and less feeling of the heights, in which inexperienced workers of less number can build safely, quickly, readily, and economically.

The foregoing object is accomplished with an apparatus for uprightly securing steel frame posts, including an access platform for work on a high location, which travels along rails and is formed with a platform board horizontally supported, and X-Y adjusters for temporarily supporting the steel frame posts, disposed at an edge of the access platform. This apparatus allows workers to work on the stable access platform and to handle only the X-Y adjuster readily, so that the workers of less number can build safely, quickly, and readily.

According to a preferred embodiment, the X-Y adjuster mainly includes a fixed base disposed on the access platform, a longitudinal slide for sliding longitudinally, a traverse slide for sliding transversely and receiving means for receiving the steel frame post disposed on the transverse slide. Disposed between the fixed base and the longitudinal slide are a longitudinal guide rail disposed on a top surface of the fixed base, and a longitudinal groove disposed beneath the longitudinal slide to slidably fit to the longitudinal guide rail. Disposed between the longitudinal slide and the transverse slide are a transverse guide rail disposed on the longitudinal slide, and a transverse groove disposed beneath the transverse slide to slidably fit to the transverse guide rail. The positions of the longitudinal slide and the transverse slide are shifted by a longitudinally feeding handle and a transversely feeding handle, respectively, which are formed with a shaft having a thread meshing a corresponding thread hole. The receiving means includes a protruding bar and a coupler. The protruding bar couples with the coupler applied to the steel frame post.

According to another aspect of the invention, a method for uprightly securing steel frame posts, includes the step of hoisting the steel frame post with a crane, temporarily supporting a head portion protruded from a top of the steel frame post with an X-Y adjuster disposed at an edge of a travelable access platform, and adjusting a position of the steel frame post so as to be secured upright by controlling the X-Y adjuster. A vice can be used for coupling between the X-Y adjuster and the steel frame post.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
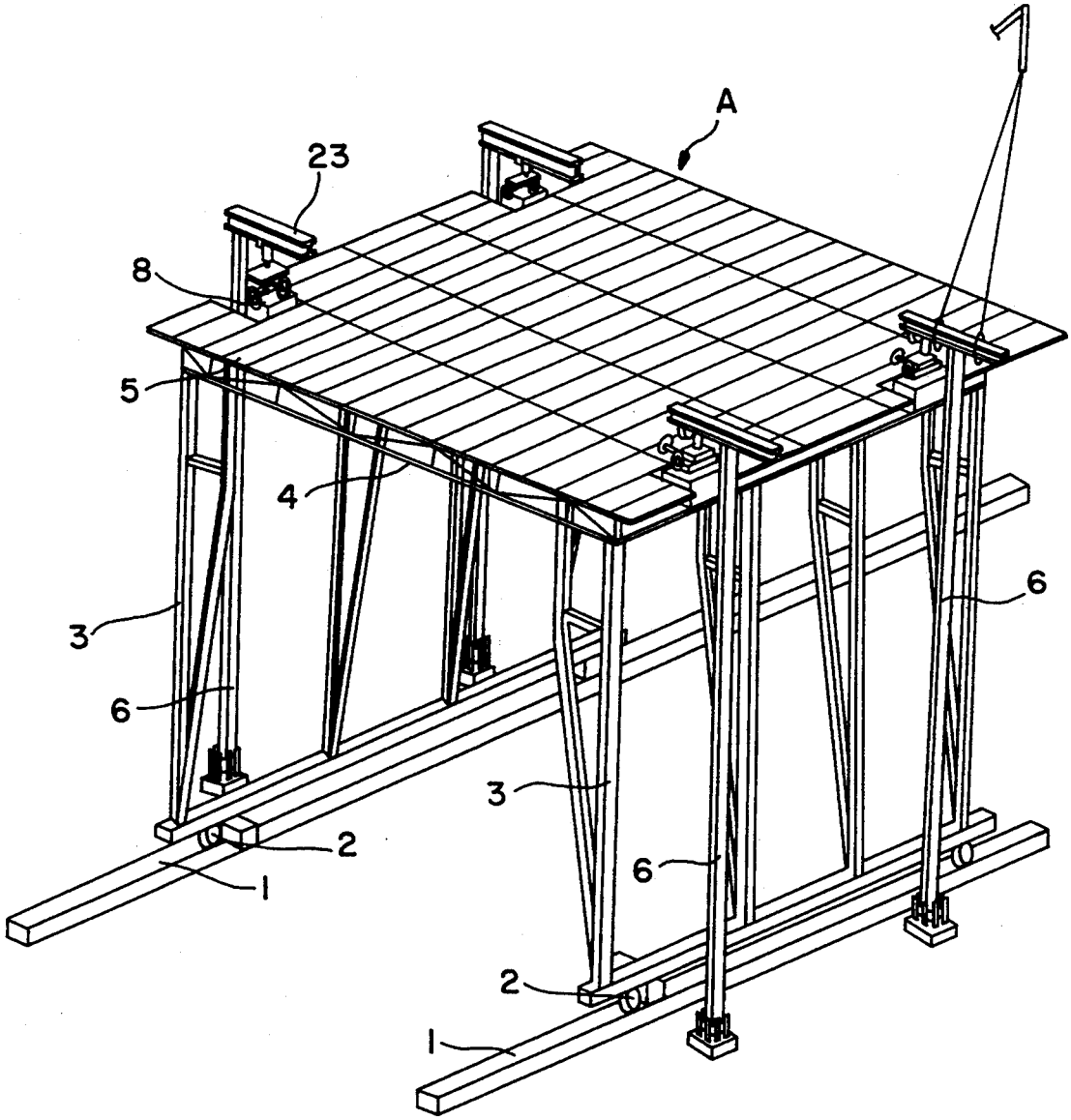
FIG. 1 is a perspective view showing, with steel frame posts, an apparatus for uprightly securing a steel frame post according to the invention.
Figure 2:
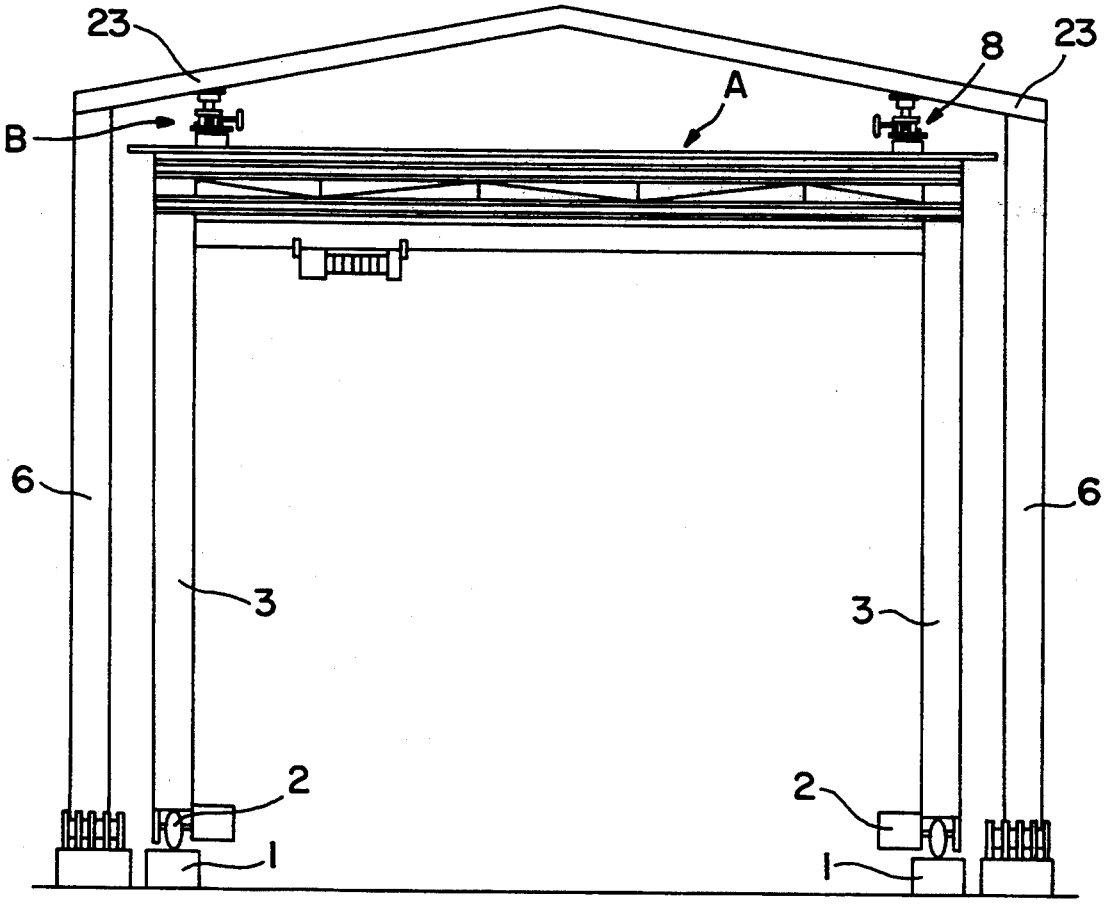
FIG. 2 is a side view showing the apparatus in FIG. 1.
Figure 3:
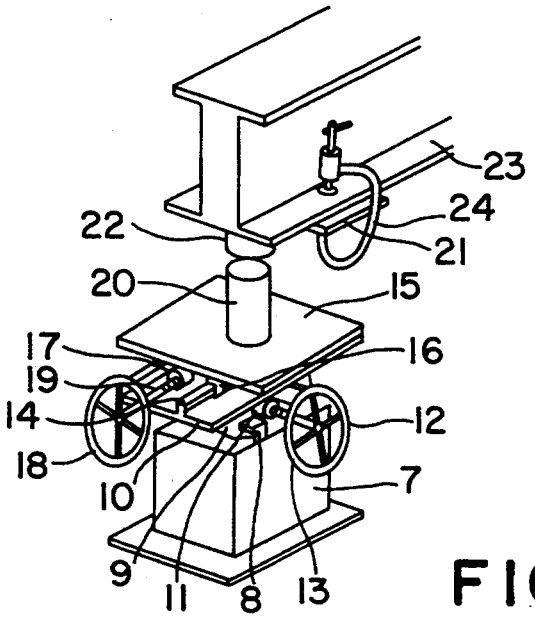
FIG. 3 is a perspective view showing an X-Y adjuster of the apparatus of FIG. 1.
Figure 4:
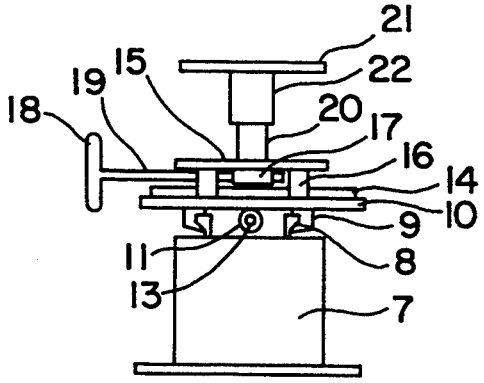
FIG. 4 is a side view showing the X-Y adjuster in FIG. 3.
Figure 5:
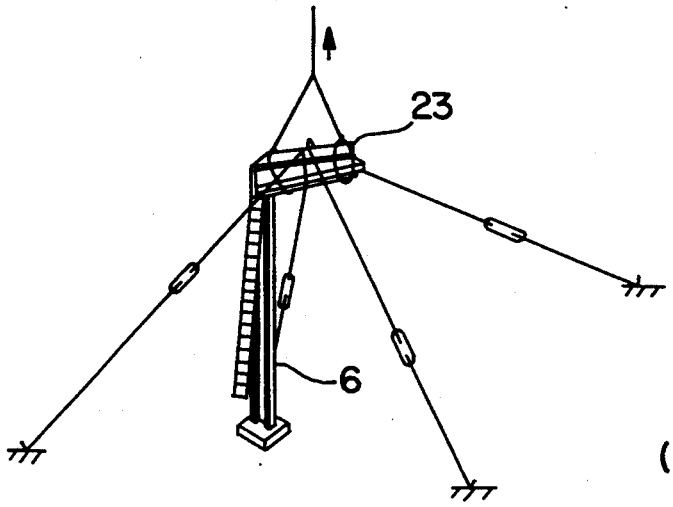
FIG. 5 (PRIOR ART)
FIG. 5 is a perspective view showing a conventional method for uprightly securing a steel frame post.

Referring to the drawings in detail, in particular, to FIGS. 1, 2, an apparatus for uprightly securing steel frame posts according to a preferred embodiment of the invention is shown. The apparatus is constituted of a travelable access platform A for safely and quickly building with adjustment of the steel frame post, arranged at a higher position and controlled by less number of workers even who are inexperienced, and a plurality of X-Y adjusters B disposed at the edge of the access platform A. The access platform A has two pairs of long leg trestles 3, 3 provided with wheels 2, 2, tracking a way of rail pair 1, 1 placed in parallel on the ground surface, driven by motors at lower ends thereof, respectively, so that the access platform A is able to travel by itself. The trestles 3, 3 fixedly support a plurality of transverse beams 4 so that the transverse beams 4 cross between the trestles. A platform board 5 is laid on the transverse beams 4 through top supporting portions. The X-Y adjusters B are disposed at proper positions of the edge of the access platform A for temporarily securing the steel frame posts 6 and adjusting positions of the posts 6.

The access platform A has height and width corresponding to a construction for which the steel frame posts 6 are used, and the edge of the access platform A is placed closely to each posts 6. The height of the access platform A is set so that the clearance between the platform board of the access platform A and the head portions of the posts becomes 70 centimeters approximately. The apparatus travels in an automotive manner along the rail pair 1, 1 to a suitable location for building when needed.

Each X-Y adjuster B is fixed to a surface of and is placed at the edge of the access platform A, which is located closely to each steel frame post hoisted by a crane. In the X-Y adjuster B, a fixed base 7 with a pair of longitudinal guide rails 8, 8 extending horizontally, longitudinally formed on a top surface thereof mounts a longitudinal slide 10 thereon. Longitudinal slidable frames 9, 9 are formed at a bottom surface of the fixed base 7 so as to slidably fit to the longitudinal guide rails 8, 8, respectively. A thread hole 11, or nut, is arranged at the longitudinal slide 10. The fixed base 7 supports a longitudinal feeding handle 12 so that the handle 12 can be rotated around its shaft 13 by worker's hand easily. The shaft 13 has a thread to mesh with the thread hole 11. Therefore, when the longitudinal feeding handle 12 is rotated, the shaft 13 forces the longitudinal slide 10 to move linearly through a thread couple. Disposed on the longitudinal slide 10 are transverse guide rails 14, 14 extending horizontally and transversely, which are slidably fitted to transverse slidable frames 16, 16 extending transversely disposed at a bottom surface of a transverse slide 15. A thread hole 17 is disposed at the bottom of the transverse slide 15. The longitudinal slide 10 supports a transverse feeding handle 18 so that the handle 18 can be rotated around its shaft 19 in the same manner to that of the handle 12. The shaft 19 has a thread to mesh with the thread hole 17. Therefore, when the transverse feeding handle 18 is rotated, the shaft 19 forces the transverse slide 15 to move linearly with respect to the longitudinal slide 10 through a thread couple. The direction of the movement of the transverse slide 15 is perpendicular to that of the longitudinal slide 10.

On the top surface of the transverse slide 15, a protruding bar 20 is disposed so as to extend perpendicularly from the top surface. The protruding bar 20 is capable of coupling with a coupler, which is composed of a cylinder 22 and an attachment board 21. The cylinder 22 incorporates a cylindrical hollow capable of inserting the protruding bar 20 thereinto. The attachment board 21 is formed as a square flat rigid board and is provided fixedly at a top of the cylinder 22. When the position of the steel frame post is adjusted, the attachment board 21 is applied to a bottom of a head portion of the steel frame post.

In operation, the steel frame post is hoisted by a crane, and then, the attachment board 21 of the coupler is attached to a bottom of a head portion laterally protruded from a top of the steel frame post by means of a vice 24. After the coupler is attached to the steel frame post by the vice 24, the protruding bar 20 is inserted into the cylindrical hollow of the cylinder 22 for holding the steel frame post temporally. To secure the steel frame post uprightly, first the handles 12, 18 ,are rotated individually by both hands of the worker so as to slide the longitudinal slide 10 and the transverse slide 15 for shifting the position of the protruding bar 20. Shifting the position of the protruding bar 20 in X and Y directions allows the protruding bar 20 to move to a suitable position for making the steel frame post upright. After adjustment of the position of the steel frame post, the steel frame post is permanently secured, and then, the vice 24 is detached from the steel frame post.

This adjustment procedure is performed on the stable, wide access platform. This avoids the worker from feeling heights. An experiment shows that some worker does not feel there as heights at all when the access platform is set from 15 to 40 meters in height. The access platform in this apparatus is so stable, different from an unstable conventional platform, that only one worker, even who is an unskilled person, can work adequately and quickly for adjusting the steel frame post to upright. That is, the total number of the workers for the adjustment is reduced from four to two, and the time for adjustment is reduced to one third of the conventional process, while the adjustment is proceeded under safety and easy conditions. This also results in high efficiency and a low cost.

The crane can be separated at a time fight after the coupler being fixed to the steel frame post is connected to the protruding bar. Adjustments of a plurality of steel frame posts can be proceeded simultaneously without securing permanently any of the steel frame posts. After those posts are temporarily held in upright positions, respectively, permanent securing process, such as a process for connections of beams, can be efficiently done at once using the wide access platform in accordance with the proceeding of the construction. This leads to save time for the construction.

It is to be noted that the access platform may be built with a hoist movable along a rail arranged below the access platform so as to hoist building materials and to turn over them. The access platform can be used for finishing, painting or other purposes using options. Moreover, it is possible to lift the platform board up and down by a hydraulic system.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. An apparatus for uprightly securing steel frame posts, comprising:

an access platform self-propelled along a pair of parallel rails by means of a plurality of wheels respectively provided at respective bottoms of trestles thereof and driven by motors respectively provided at said wheels, said access platform having a platform board provided on transverse beams supported horizontally and fixed on a pair of said trestles; and X-Y adjusting means for independently adjusting the X and Y position of the steel frame post while temporarily supporting the steel frame post, wherein said X and Y position are located in a horizontal plane, said X-Y adjusting means disposed at an edge of said access platform.

2. An apparatus for uprightly securing steel frame posts as set forth in claim 1, wherein said X-Y adjuster means comprises a plurality of X-Y adjusters.

3. An apparatus for uprightly securing steel frame posts as set forth in claim 2, wherein said X-Y adjuster comprises:

a fixed base disposed on said access platform, having a longitudinal guide rail disposed on a top surface thereof, said longitudinal guide rail extending longitudinally;

a longitudinal slide having a longitudinal slidable frame disposed at a bottom surface thereof, said longitudinal slidable frame extending longitudinally and fitting to said longitudinal guide rail, a transverse guide rail disposed on a top surface thereof, said transverse guide rail extending transversely, and a longitudinal thread hole formed therethrough extending longitudinally;

a longitudinally feeding handle supported by said fixed base, a shaft of said longitudinally feeding handle having a thread meshing said longitudinal thread hole;

a transverse slide having a transverse slidable frame disposed at a bottom surface thereof and a transverse thread hole, said transverse slidable frame extending transversely and fitting to said transverse guide rail;

a transversely feeding handle supported by said longitudinal slide, a shaft of said transversely feeding handle having a thread meshing said transverse thread hole; and receiving means for receiving said steel frame post disposed on a top surface of said transverse slide.

4. An apparatus for uprightly securing steel frame posts as set forth in claim 3, wherein said receiving means comprises:

a protruding bar fixed to and extending uprightly from a top surface of said transverse slide; and a coupler having a cylindrical hollow capable of inserting said protruding bar therein and an attachment board provided at a top thereof for applying a bottom of a head portion of said steel frame post.

5. An apparatus for uprightly securing steel frame posts as set forth in claim 1, wherein said access platform is adapted to have a height of 70 centimeters lower than the height of a head portion of said steel frame post.

6. An apparatus for uprightly securing steel frame posts as set forth in claim 1, wherein said access platform has a height in a range from 15 meters to 40 meters.

7. An apparatus for uprightly securing steel frame posts as set forth in claim 3, wherein said X-Y adjuster has respective pairs of longitudinal guide rails, longitudinal slidable frames, transverse guide rails, and transverse slidable frames.

8. An apparatus for uprightly securing steel frames posts as set forth in claim 1, wherein said X-Y adjuster moves said frame post only in longitudinal and transverse directions.

9. An apparatus for uprightly securing steel frames posts as set forth in claim 1, wherein said X-Y adjuster is capable of movement in the X only direction and the Y only direction.

10. A method for uprightly securing steel frame posts, comprising the steps of:

hoisting a steel frame post with a crane;

temporarily supporting a head portion protruded from a top of said steel frame post with X-Y adjusting means for independently adjusting the X and Y position of said steel frame post disposed at an edge of a self-propelled access platform wherein said X and Y position are located in a horizontal plane; and adjusting a position of said steel frame post so as to be secured upright by controlling said X-Y adjuster.

11. A method for uprightly securing steel frame posts as set forth in claim 10, further comprising the step of attaching a coupler having a flat top to said head portion of said steel frame post by means of a vice before temporally supporting said head portion.

12. A method for uprightly securing steel frame posts as set forth in claim 10, wherein said X-Y adjusting means are a plurality of X-Y adjusters for temporally supporting the same number of the steel frame posts simultaneously.

13. A method for uprightly securing steel frame posts as set forth in claim 10, further comprising the step of only moving said X-Y adjuster in longitudinal and transverse directions.

14. A method for uprightly securing steel frame posts as set forth in claim 10, further comprising the step of moving said X-Y adjuster in an X only direction and moving said X-Y adjuster in a Y only direction.

* * * * *